United States Patent [19]

Anderka et al.

[11] Patent Number: 4,549,828

[45] Date of Patent: Oct. 29, 1985

[54] WRITING INSTRUMENT WITH SEPARABLE COMPENSATING MEANS

[75] Inventors: Gerold Anderka, Ellerbek; Rolf Tenhagen, Henstedt-Ulzburg, both of Fed. Rep. of Germany

[73] Assignee: Rotring-Werke Riepe KG, Hamburg, Fed. Rep. of Germany

[21] Appl. No.: 554,141

[22] Filed: Nov. 21, 1983

[30] Foreign Application Priority Data

Dec. 3, 1982 [DE] Fed. Rep. of Germany ..... 3244697

[51] Int. Cl.[4] ..... B43K 5/16; B43K 1/06; B43K 1/10

[52] U.S. Cl. ..... 401/258; 401/259

[58] Field of Search ..... 401/258, 259, 260, 227

[56] References Cited

U.S. PATENT DOCUMENTS

| | | | |
|---|---|---|---|
| 3,442,597 | 5/1969 | Hebborn et al. | 401/259 |
| 3,539,269 | 11/1970 | Dahle . | |
| 3,778,754 | 1/1974 | Glasa . | |
| 3,824,023 | 7/1974 | Danjczek et al. . | |
| 3,870,421 | 3/1975 | Mutschler . | |
| 4,207,012 | 6/1980 | Kuparinen . | |
| 4,382,707 | 5/1983 | Anderka . | |
| 4,390,299 | 6/1983 | Mutschler . | |
| 4,461,591 | 7/1984 | Mutschler | 401/258 |

FOREIGN PATENT DOCUMENTS

| | | | |
|---|---|---|---|
| EP35736 | 9/1981 | European Pat. Off. | 401/259 |
| 1967021 | 5/1976 | Fed. Rep. of Germany . | |
| 3009100 | 5/1982 | Fed. Rep. of Germany . | |
| 3009169 | 7/1982 | Fed. Rep. of Germany . | |
| 7904617 | 12/1980 | Netherlands | 401/258 |
| 1322477 | 7/1973 | United Kingdom . | |
| 2072587 | 10/1981 | United Kingdom | 401/259 |

*Primary Examiner*—Steven A. Bratlie

*Attorney, Agent, or Firm*—Warren E. Olsen; David H. Semmes

[57] ABSTRACT

A writing instrument of the type having a cylindrical body (1), with a forward end that carries a writing tubule (4) and an inner bore which communicates with the writing tip. A separate sheath body (15) is adapted to be covered by a sheath element (9). The sheath body is pushed onto the rearward end of the cylindrical body (1) and defines a compensating chamber (12, 14) on each of its outer and inner faces. The compensating chambers are connected proximate their rearward ends by a connecting bore (13). The inner compensating chamber (14) communicates with the inner bore through a transverse bore (7) provided in the forward area of the cylindrical body (1). A writing fluid tank (11) is mounted by being pushed onto the rearward end of the cylindrical body (1).

3 Claims, 1 Drawing Figure

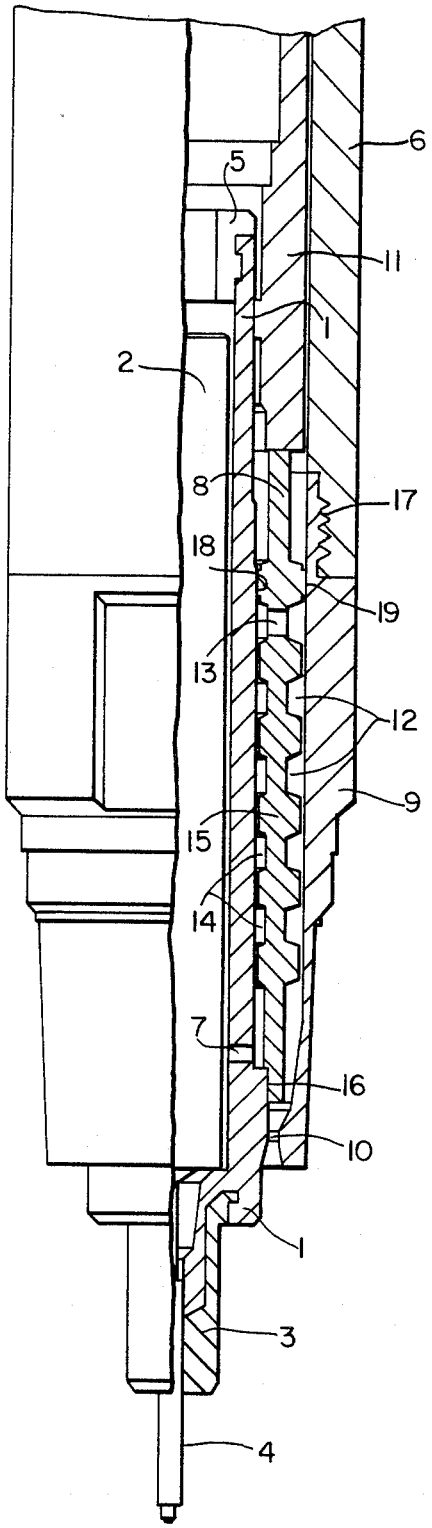
6
5
11
1
2
8
17
18
19
13
12
9
15
14
7
16
10
1
3
4

WRITING INSTRUMENT WITH SEPARABLE COMPENSATING MEANS

BACKGROUND OF THE INVENTION

1. Field of the Invention

The present invention relates to a writing instrument having a writing tip, in particular a tubular writing tip. The instrument also has a tank for writing fluid which can be pushed from behind, onto a cylindrical body which, on its forward end, carries a writing tubule, writing tip or the like. A compensating chamber means is in the vicinity of the instrument forward end, and is in sealing engagement with the cylindrical body. The ink compensating chamber means is a sheath body with an inner surface defining an inner compensating chamber that communicates, at its forward end, with a transverse bore provided in the forward end area of the cylindrical body, and into the inner bore of the cylindrical body. At its rearward end the inner, ink compensating chamber communicates, via a connecting bore, through the wall of the compensating chamber sheath body, with an outer ink compensating chamber provided about the outer surface of the compensating chamber sheath body. The outer compensating chamber is covered by a sheath element, and the forward end of the outer compensating chamber communicates with ambient air between this sheath element and the cylindrical body.

2. Brief Description of the Prior Art

In a known writing instrument of this type, which is illustrated in certain prior patents by ANDERKA (DE 30 09 100 C2, DE 30 09 169 C2, EP 35,736 and copending U.S. Ser. No. 06/529,654) a compensating chamber area is molded onto the forward end of the tank for writing fluid, so that both the writing fluid tank and the compensating chamber area can be mounted or pushed in common onto the cylindrical body, from behind. The outer compensating chamber is covered by a sheath element that is embodied as a separate piece from the cylindrical body and can be removed toward the front, so as to expose the outer compensating chamber.

In this known writing instrument, the user can clean the compensating chambers each time the writing fluid tank is refilled; as the writing fluid tank is removed for the purpose of refilling, the compensating chambers are exposed. If the writing fluid tank is embodied as a cartridge of writing fluid, such cleaning of the compensating chambers is not required. If one writing fluid cartridge is exchanged for another, clean compensating chambers automatically are put into place as well.

While this previously known writing instrument thus enables optimal cleaning of the compensating chambers, it has the disadvantage that the manufacture of a writing fluid tank, with a compensating chamber means provided on its forward end, is relatively expensive.

It is true that another writing instrument is known, as illustrated in certain prior patents by GLASA et al. (DE 21 59 522 and GB 1 322 477) in which inner and outer compensating chambers are embodied on a sheath body which can be inserted from the front, and into an annular chamber of a cylindrical body. In this known writing instrument the inner and outer compensating chambers are disposed in parallel, that is, their rearward ends are in direct communication with a transverse bore communicating with an inner bore. Furthermore, a special tool is required to remove the sheath body, which has a compensating chamber on both its inner and outer faces. Consequently, the user will only very seldom undertake to clean the compensating chambers.

OBJECT AND SUMMARY OF THE INVENTION

It is, accordingly, an object of the invention to improve a writing instrument of the general type discussed above, such that the writing fluid tank is simpler in design and, therefore, can be manufactured more economically.

In order to attain this object, a writing instrument is embodied in accordance with the invention such that the compensating chamber means comprises a sheath body which is separate from the writing fluid tank, and with a rearward end area that is in sealing engagement both with the outer face of the cylindrical body and the inner face of a surrounding sheath element.

In a writing instrument according to the invention, the writing fluid tank and the compensating chamber means are separate components, and the writing fluid tank can be manufactured very simply. This is particularly advantageous if the writing fluid tank takes the form of a cartridge, or otherwise is a replaceable part which, after its contents are used up, is disposed of and replaced with a new cartridge. The separate sheath body has passages formed within its outer and inner surfaces, and thereby embodies the major portion of the compensating chamber means, and also is relatively easy to manufacture. The sheath body is separate from the writing fluid tank and, therefore, also is a relatively simple element to manufacture.

Furthermore, cleaning of the sheath body now can be accomplished in two steps. First, the sheath element that covers the outer compensating chamber is comprised of a smooth, inner surface and is threadingly engaged, at its rear end, to the front end of the pen holder shaft, whereby the sheath element is unscrewed towards the front of the writing instrument, in order to be removed. The passages defining the major portion of the outer compensating chamber then are exposed and can be cleaned, while the sheath body itself remains in its position on the cylindrical body. After the surrounding sheath element has been removed, the sheath body then can be removed over the rest of the cylindrical body without requiring the aid of a tool, because the sheath body outer surface also is freely accessible and the entire writing instrument then is separated axially, by simply grabbing the holder shaft and a point proximate the cylindrical body forward end.

To attain particularly good sealing in the end areas of the sheath body, this component is preferably made of a plastic with an elastic deformability that is greater than that of the plastic employed for the cylindrical body and the surrounding sheath element.

The invention will now be described in greater detail, referring to the drawing.

BRIEF DESCRIPTION OF THE DRAWING

The single drawing FIGURE shows a tubular writing instrument with its holder shaft threaded into place, partly in a front view and partly in section.

DESCRIPTION OF THE PREFERRED EMBODIMENT

The tubular writing instrument shown in the drawing includes a cylindrical body 1, in the forward end of which the writing tubule 4 is held, by means of a metal socket 3 embedded in the cylindrical body. Located within an inner bore of the tubular cylindrical body 1 is a drop weight body 2, having a forward end connected to a cleaning wire, in a manner not shown in detail. The cleaning wire extends into the writing tubule 4 and can be moved back and forth in the axial direction with the drop weight body 2. A drop weight retainer 5, having a central opening, is inserted into the rearward end of the cylindrical body 1. The forward end area of the cylindrical body 1 has a transverse bore 7, which connects the outer cylindrical surface of the cylindrical body 1 with the inner bore thereof.

A sheath body 15 is pushed from behind onto the cylindrical body 1 until its forward end is stopped by abutting in sealing engagement with the cylindrical body 1, as at 16. The rearward end of the sheath body 15 also rests in a sealing manner, 18, against the outer face of the cylindrical body 1, and further comprises a sheath body extending rearward section, 8. The transverse bore 7 is in communication with the forward end of a helical inner, ink compensating chamber 14, which is defined by the inner face of the sheath body 15, and is covered by the outer face of the cylindrical body 1. Proximate the rearward end of the inner compensating chamber 14, is a connecting bore 13, which extends through the wall of the sheath body 15, and into a helical, ink compensating chamber 12, which extends toward the front and is defined substantially by the outer face of the sheath body 15. The outer compensating chamber 12 is covered by a cylindrical sheath element 9 which has a screw thread and mounts upon the holder shaft, from the front. The sheath body rearward extending section 8 comes to rest against a forward shoulder of the ink tank 11, as a result of final positioning of the sheath element 9. Other results of that positioning are a sealing engagement at 19 between the sheath body 15 and the inner surface of sheath element 9, and an outer compensating chamber 12 that communicates with the ambient air via an annular chamber 10, formed between the cylindrical body 1, and the sheath element 9.

The ink tank is pushed onto the cylindrical body 1 from behind, and a holder shaft 6 has a forward end, which is rearward of the sealing engagement at 19 and is threaded to accept the threads 17 of the sheath element 9. In order to prevent the assembled unit (comprising cylindrical body 1, sheath element 9 and ink tank 11) from being pushed too far into the holder shaft 6, a stop (not shown) may be provided within the upper or rearward area of the holder shaft 6, to support the ink tank 11 and prevent excessive axial displacement.

In the preferred tubular writing instrument embodiment shown, the ink tank 11 can be removed for refilling (or replaced, if a cartridge) by unscrewing the holder shaft 6 and then removing (or replacing) the tank.

In order to clean or replace the sheath body 15, the sheath element 9 first is unscrewed from the holder shaft 6, then displaced forward to be removed. The cylindrical body 1 remains and supports the writing tubule 4 and the metal socket 3. The outer compensating chamber 12 thereupon is exposed, and in this position it easily can be cleaned. To then remove the entire sheath body 15, either for replacement or for cleaning of the inner compensating chamber 14, the writing instrument is grabbed about the holder shaft 6, and about the metal socket 3 and axially separated. The sheath body 15 thereby slides off the rear extension of the cylindrical body 1, without the aid of any specialized tool.

After a new or cleaned sheath body 15 is put in place upon the cylindrical body, the sheath element 9 is pushed back from the front and a filled ink tank 11 pushed from behind, onto the cylindrical body 1. The holder shaft 6 then can be screwed onto the thread 17 of the sheath element.

Having described a preferred embodiment, the invention is to be defined by the scope of the appended claims.

I claim:

1. In a tubular writing instrument of the type comprising a writing fluid tank (11) capable of being pushed from behind onto an outer surface of a cylindrical body, (1) having an inner bore communicating between said tank and a writing tubule carried at the forward end of said cylindrical body (1), an ink compensating means in sealing engagement about said cylindrical body which further comprises an inner ink compensating chamber, which is defined between a smooth outer surface of said cylindrical body and passages formed within an inner surface of a wall element (15), said inner ink compensating chamber having a forward end that communicates to said inner bore through a transverse bore (7) in said cylindrical body, wherein said ink compensating means further comprises an outer ink compensating chamber, which is defined between passages formed within an outer surface of said wall element and a smooth inner surface of a sheath element, wherein further the forward end of the outer ink compensating chamber communicates to ambient air through an opening defined between said cylindrical body outer surface and said sheath element and, further, the rearward end of said inner ink compensating chamber communicates with said outer ink compensating chamber via a connecting bore through said wall element, the improvement which comprises a wall element which comprises a sheath body (15) which is adapted to be pushed from the rear onto the outer surface of said cylindrical body (1) and is separate from said writing fluid tank, said sheath body having a forward end adapted to abut against a forward surface of said cylindrical body and having a rearward end in sealing engagement between said cylindrical body (1) and said sheath element (9) at a point proximate and rearward to said connecting bore, said sheath body (15) being made of a plastic having an elastic deformability which is greater than that of a plastic comprising either the cylindrical body (1) or the sheath element (9) wherein, further, said sheath element has a rearward end which is removably engaged to a holder shaft forward end which is rearward of said point of sealing engagement, whereby said sheath element (9) is removable, from said holder shaft towards the front of said writing instrument, thereby to expose the outer surface of said sheath body (15) and thereafter enable said sheath body to be removed rearwardly from said cylindrical body by grabbing about the holder shaft and proximate the cylindrical body forward end, and axially separating the writing instrument.

2. In a writing instrument according to claim 1, the further improvement of a sheath body (15) having a rearward extension section (8) adapted for abutting engagement against a forward end of said writing fluid tank.

3. In a writing instrument according to claim 1, the further improvement of helical inner and outer ink compensating chambers, and a forward inner surface of said sheath body which sealingly engages against said cylindrical body so that said transverse bore is located at the forward end of said inner helical ink compensating chamber, and the forward end of said helical outer ink compensating chamber communicates to ambient air through a forward end opening which is annular.

* * * * *